United States Patent [19]

Olsen

[11] Patent Number: 4,633,802

[45] Date of Patent: Jan. 6, 1987

[54] APPARATUS FOR STORING AND LAUNCHING A FLOAT OR THE LIKE VESSEL FROM A SHIP

[75] Inventor: Karl H. Olsen, Njardvik, Iceland

[73] Assignee: Velsmidjan OL. Olsen, Njardvik, Iceland

[21] Appl. No.: 649,659

[22] Filed: Sep. 12, 1984

[51] Int. Cl.[4] ..... B63B 23/00

[52] U.S. Cl. ..... 114/367; 124/1

[58] Field of Search ..... 114/365–367; 441/42; 124/1, 16

[56] References Cited

U.S. PATENT DOCUMENTS

| | | | |
|---|---|---|---|
| 3,132,357 | 5/1964 | Fenster | 114/365 |
| 3,534,418 | 10/1970 | Adams | 114/362 |
| 4,124,911 | 11/1978 | Wildhagen | 114/367 |

FOREIGN PATENT DOCUMENTS

| | | | |
|---|---|---|---|
| 853657 | 11/1960 | United Kingdom | 114/367 |
| 853060 | 11/1960 | United Kingdom | 114/367 |

*Primary Examiner*—Trygve M. Blix
*Assistant Examiner*—Jesûs D. Sotelo
*Attorney, Agent, or Firm*—Cushman, Darby & Cushman

[57] ABSTRACT

Apparatus for storing and launching a float from a ship includes first and second arms; a device pivoting the first arm for swinging movement relative to the second arm, the second arm being adapted to be fixed to a ship; a bias device connected between the first and second arms for biasing the first arm in a direction away from the second arm; a storing device for releasably holding a float to the second arm; a retaining shaft axially movable between a retaining position and a releasing position; a blocking assembly connected to the storing device and connected to the retaining shaft in such a manner that in the retaining position of the retaining shaft the storing device holds the float to the second arm and such that movement of the retaining shaft to its releasing position releases the blocking assembly so that the holding device releases the float from the first arm, the retaining shaft in its retaining position also cooperating with the second arm in a manner to restrain swinging of the second arm by the bias device and in a manner to release the second arm when the retaining shaft moves to its releasing position; and a device for moving the retaining shaft from its retaining position to its releasing position.

6 Claims, 37 Drawing Figures

Figure 1:
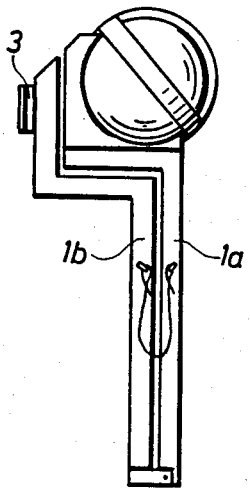

Fig.15
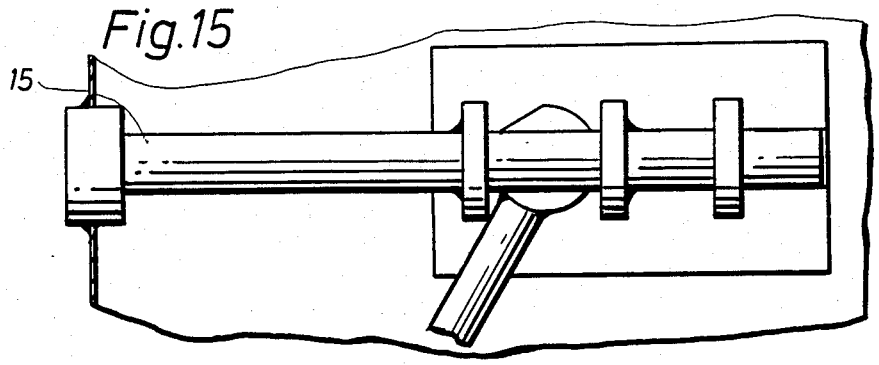
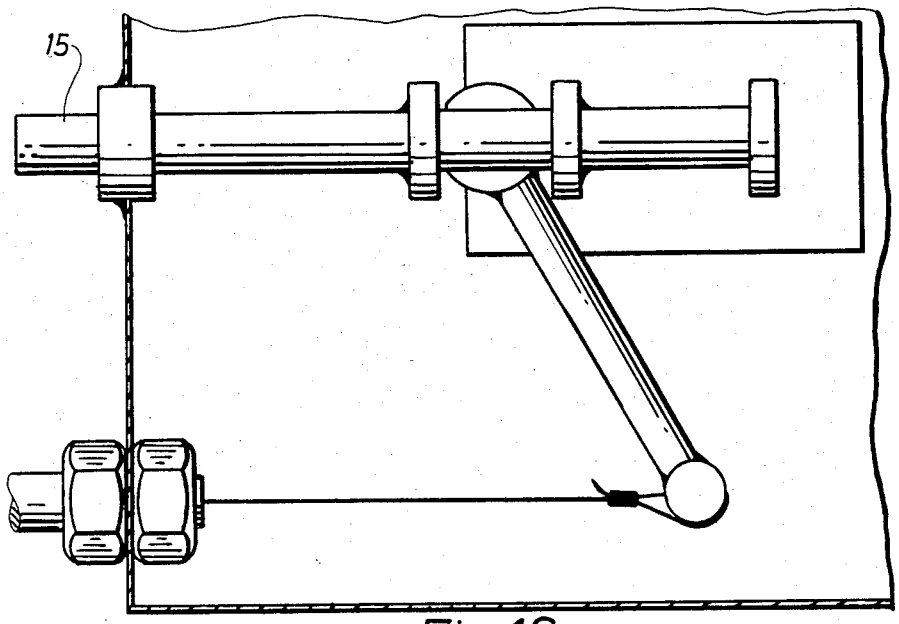
Fig.16
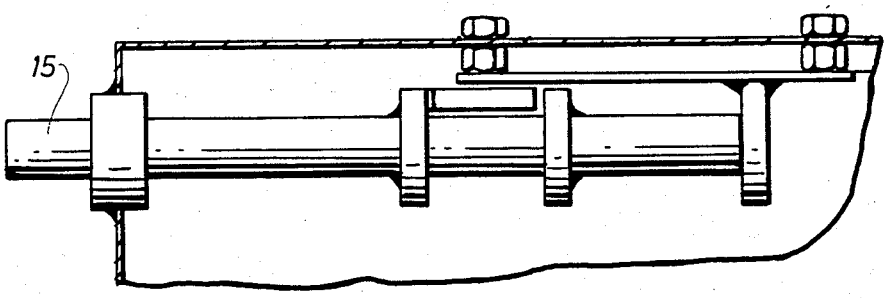
Fig.17

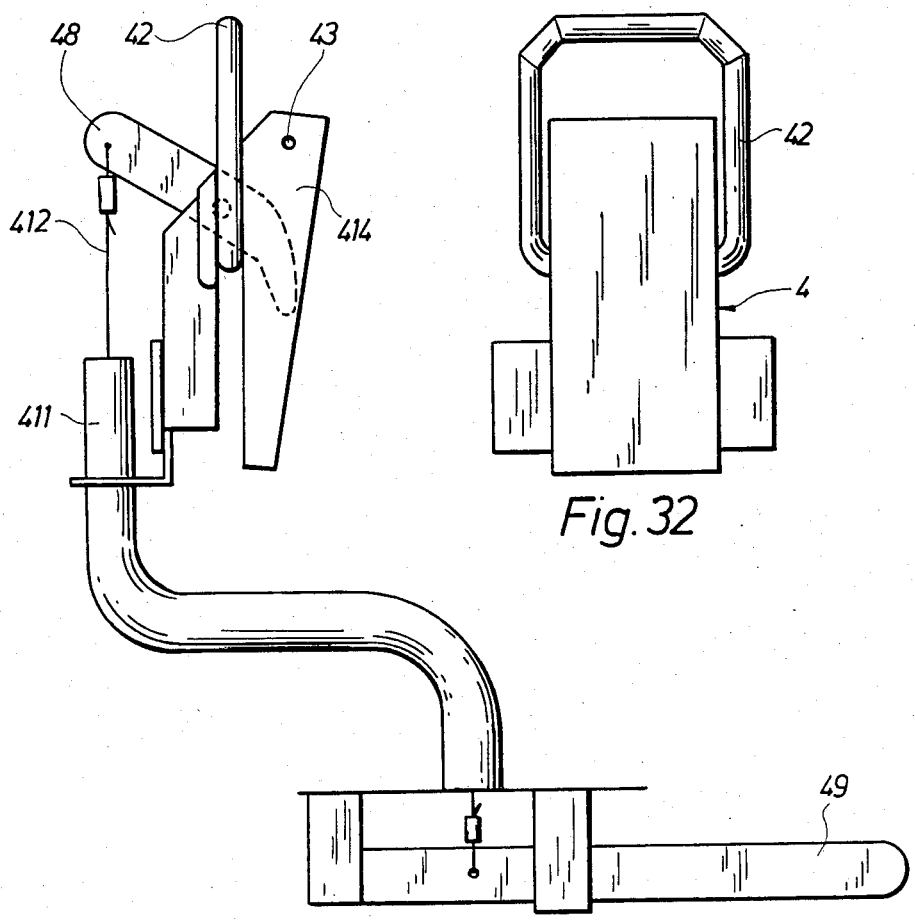
Fig. 32
Fig. 34
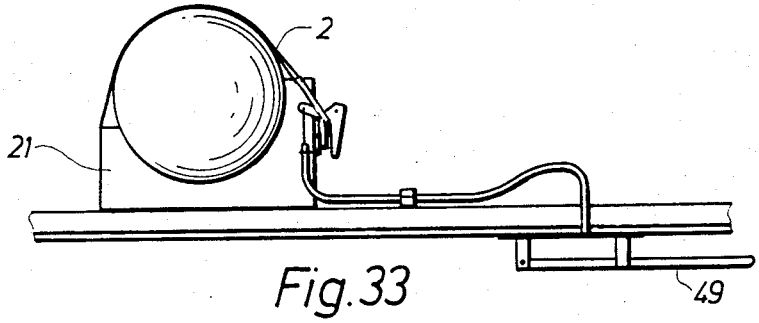
Fig. 33

APPARATUS FOR STORING AND LAUNCHING A FLOAT OR THE LIKE VESSEL FROM A SHIP

The invention relates to an apparatus for storing and launching a float or the like vessel from a ship and which comprises a carrying frame.

Apparatuses of this type are known whereby the float is mounted on a carrying frame secured on the ship. These apparatuses are rather difficult to use because the launching of the float must be carried out manually, and consequently the reliability of these apparatuses is limited.

The object of the invention is to provide an apparatus of the above type which implies that the launching of the float is more reliable in all weathers than in the case of the known apparatuses.

The apparatus according to the invention is characterised in that the carrying frame comprises two mutually movable, preferably turnable arm means, whereby one arm means is fixedly mounted on the ship and the second arm means is provided with releasable means at its outer end for storing the float, a releasable ejector being provided between the two arm means for moving, preferably turning the second arm means so as to eject the float when said float is to be launched. As a result the float is automatically and reliably launched in case the ship is in distress as the ejector ensures that the float is ejected far away from the hull regardless of the possible inclination of the ship. When the ejector is released, the storing apparatus is released too in such a manner that the float is loose relative to the arm means in the ejecting moment. In case the float is below the water level already in the ejecting moment, the apparatus positioned below the water level ejects the float away from the hull whereafter the buoyancy of the float ensures that the latter reaches the water level.

The ejector may, according to the invention, comprise a compression spring, and a move-restricting means such as a metal cable may optionally be provided between the arm means for restricting the movement of the second arm means upon release of the ejector. In this manner a very precise ejection of the float is obtained as the second arm means can only turn a specific angle relative to the first arm means.

Moreover according to the invention the releasability of the storing means may be provided by means of a releasable blocking means such as for instance in the form of a manually operable, turnable piece of hardware mounted on the first arm means. In this manner the storing means are manually releasable independently of the ejector, whereby it is possible to carry out the necessary security checks of the float without the latter being ejected.

In addition according to the invention the second arm means—on which the ejector is mounted—may be retainable against the first arm means by means of a releasable retaining arrangement mounted thereon and indirectly—namely through release of the second arm means—capable of releasing the ejector. As a result, a very reliable release of the second arm means and consequently of the ejector is obtained, namely when the retaining arrangement releases the second arm means.

Furthermore according to the invention, the blocking means may be mounted in such a manner that it can slide on a retaining shaft displaceably positioned in the retaining arrangement, said retaining shaft also being capable of cooperating with the second arm means and further being activatable by means of a steering arm in turn activatable by means of a lever mechanism connected to a handle optionally while using an auxiliary cable, whereby the blocking means is manually releasable in addition to being releasable by means of the retaining shaft. In this manner the apparatus is particularly reliable because nothing but a mere activation of the handle on the lever mechanism is necessary for carrying out the launching of the float. In this case the retaining shaft is removed both from the second arm means and from the blocking means in such a manner that the latter are released. As the blocking means is manually releasable too beyond being releasable by means of the shaft, it is easy to carry out the necessary security checks of the float without the latter being ejected.

According to the invention the compression spring of the ejector may be mounted inside a housing of three pipe portions situated inside one another, whereby the apparatus is releasable in a very reliable manner regardless of a possible inclination of the ship.

Moreover according to the invention, the ejector may be releasable, i.e. activatable, through remote control, whereby a very reliable release of the apparatus is obtained regardless of a possible heavy inclination of the ship.

In addition according to the invention, the storing means may comprise substantially crescent-shaped supporting seat portions for the float as well as holding straps extending across the float and cooperating with said blocking means. In this manner a very reliable securing of the float is obtained.

Furthermore according to the invention, the blocking means may be a substantially V-shaped arm, at the end of which a fastening member provided with catching projections is pivotably mounted, said fastening member being capable of entering a stopping position, in which the holding strap is retained, or a releasing position, in which the holding strap is released. As a result, the blocking means functions very reliably regardless of a manual or an automatic handling by means of the retaining arrangement.

According to the invention, the steering arm of the retaining arrangement may at one end comprise a cam for locking and releasing, respectively, the retaining shaft, and the latter may be provided with a coil spring mounted coaxially thereon and displacing the retaining shaft towards the releasing position thereof. In this manner a particularly reliable activation of the retaining arrangement is obtained in such a manner that said arrangement can release the second arm means and consequently the ejector.

Finally according to the invention the portion provided with a cam of the steering arm of the retaining arrangement may cooperate with projecting plates secured on the retaining shaft, said construction having proved to be particularly reliable.

Figure 2:
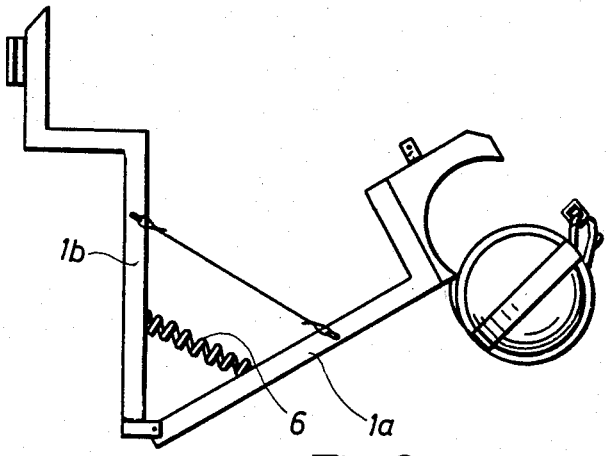
Figure 3:
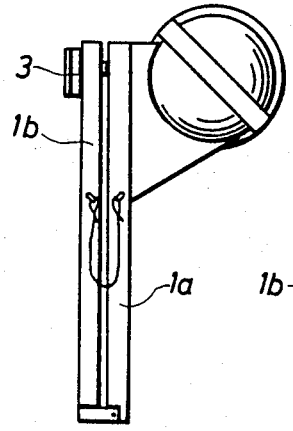
Figure 4:
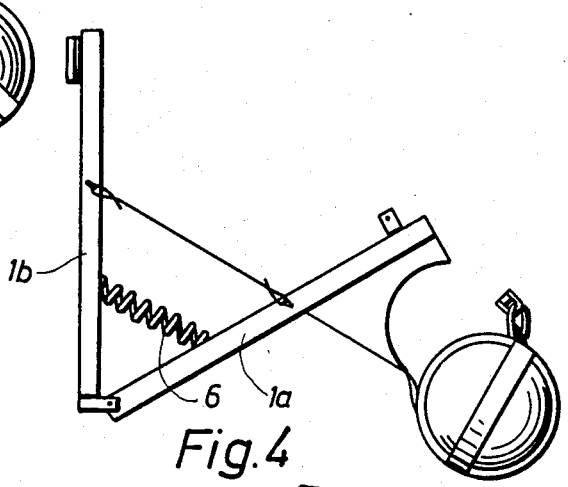
Figure 5:
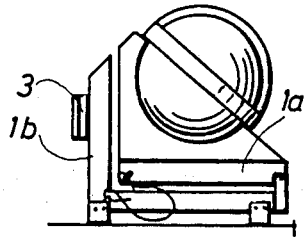
Figure 6:
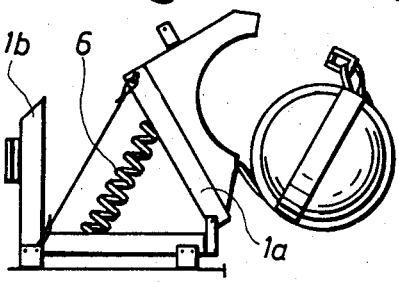
Figure 7:
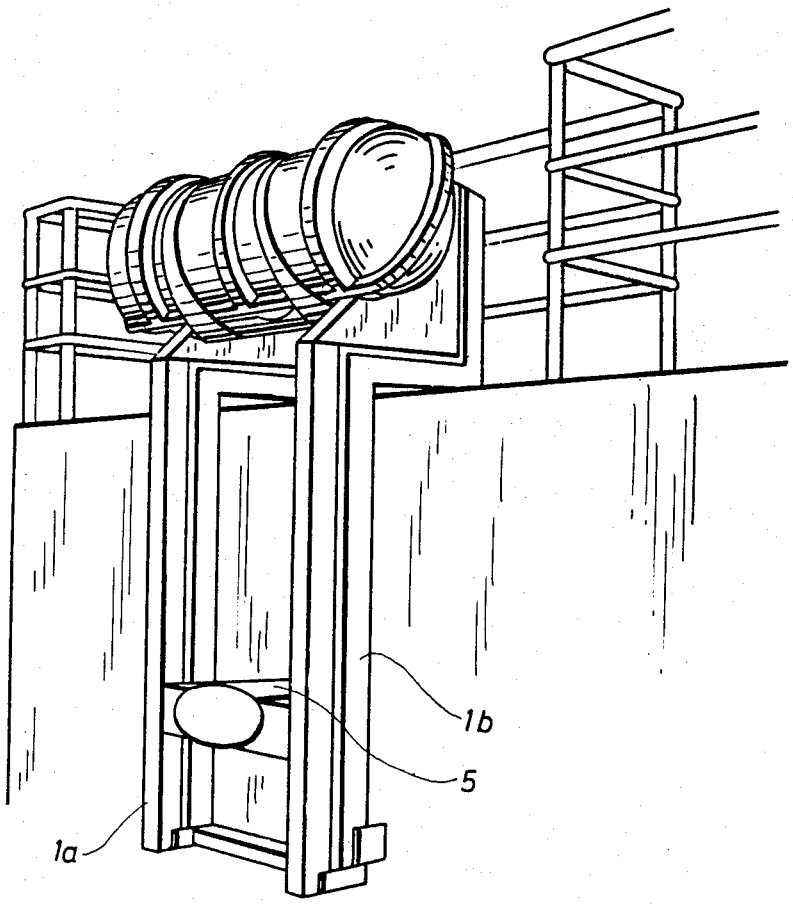
Figures 8, 9:
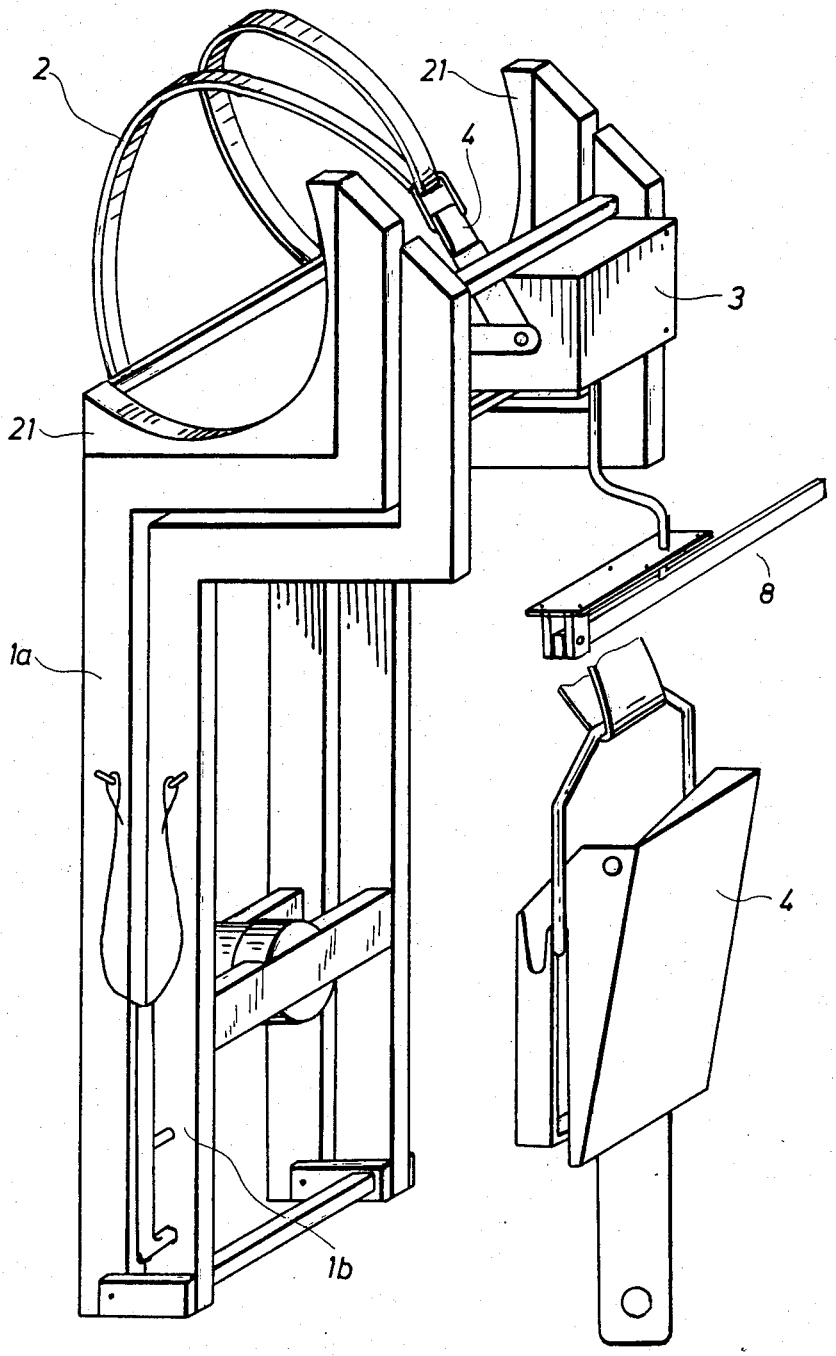
Figure 10:
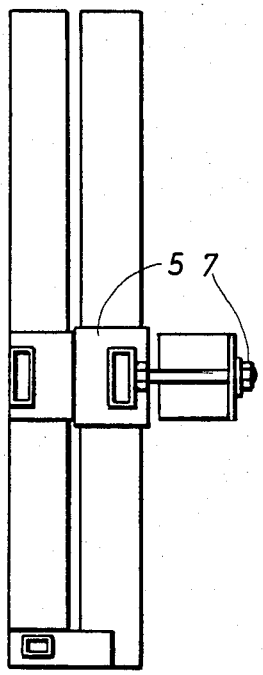
Figure 11:
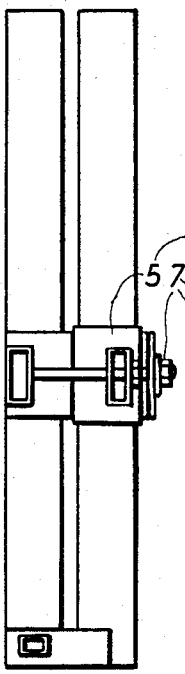
Figure 12:
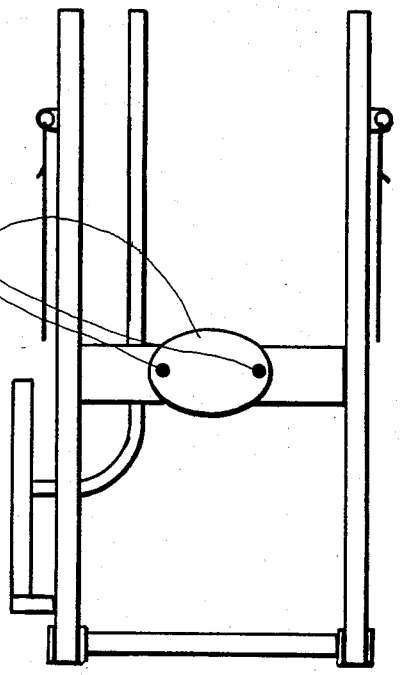
Figure 13:
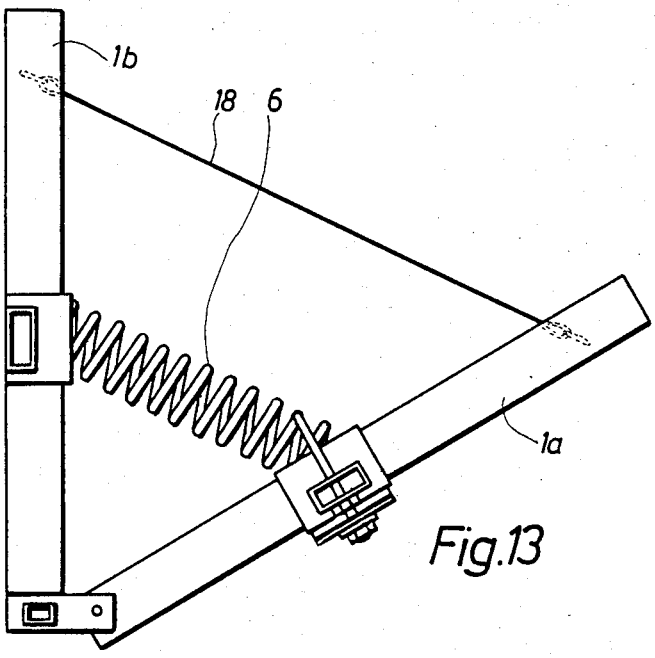
Figure 14:
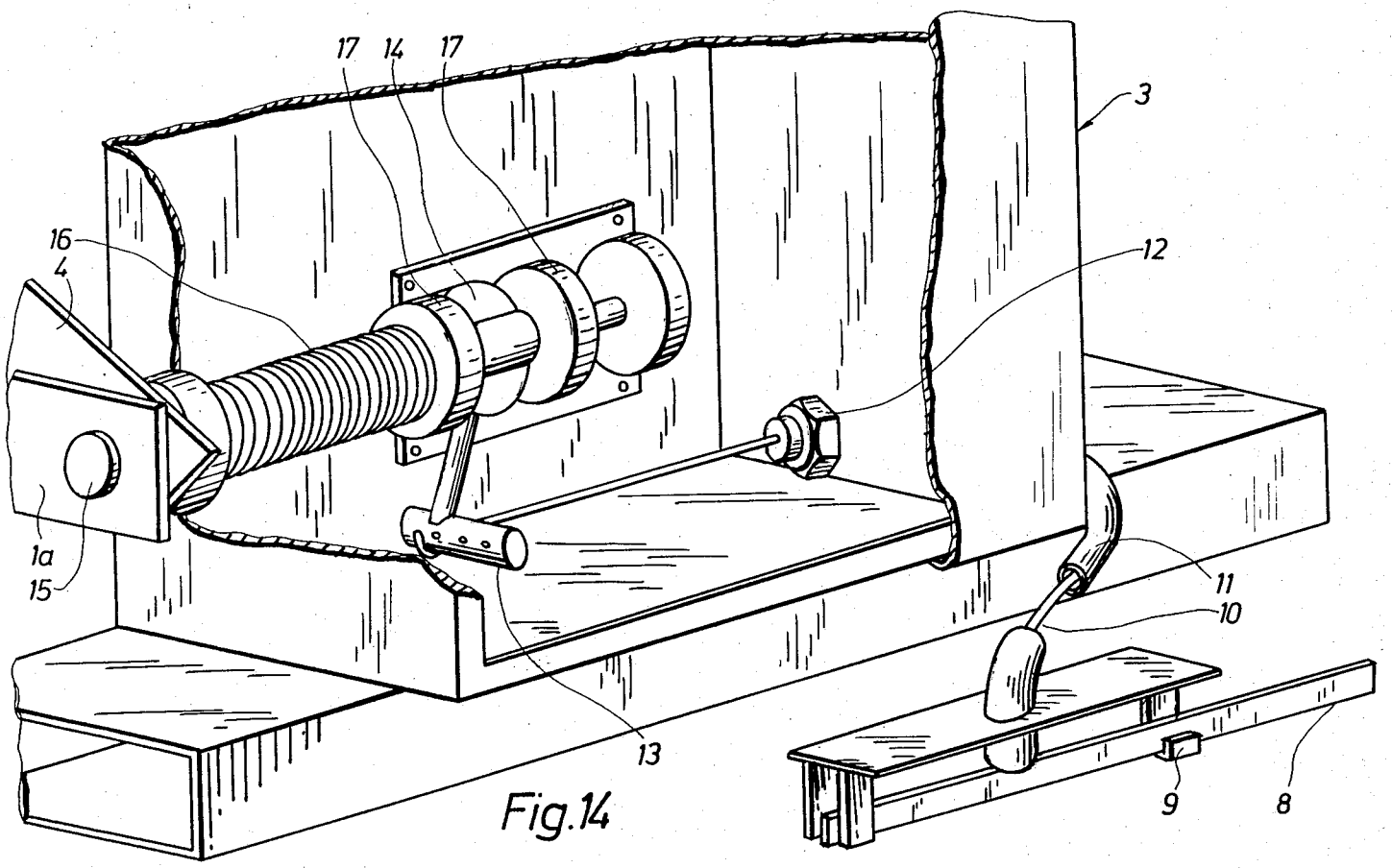
Figure 18:
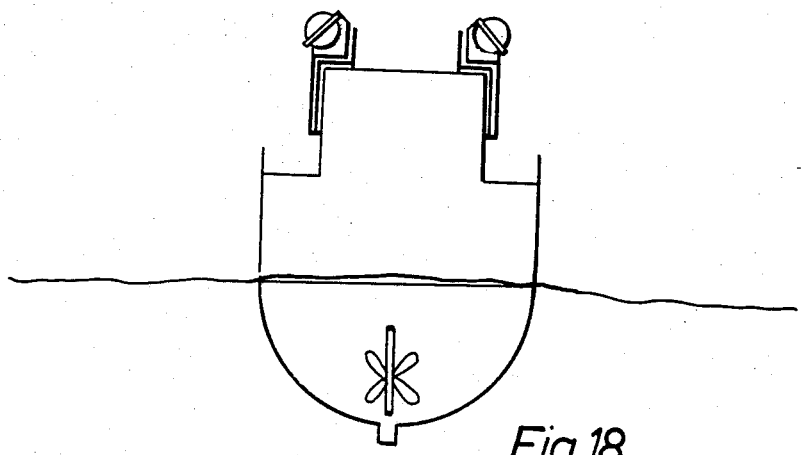
Figure 19:
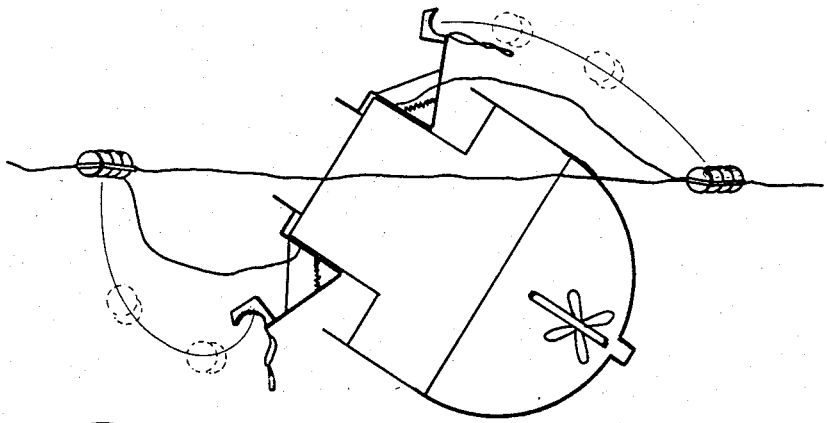
Figure 20:
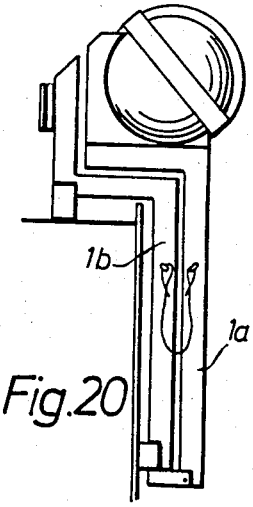
Figure 21:
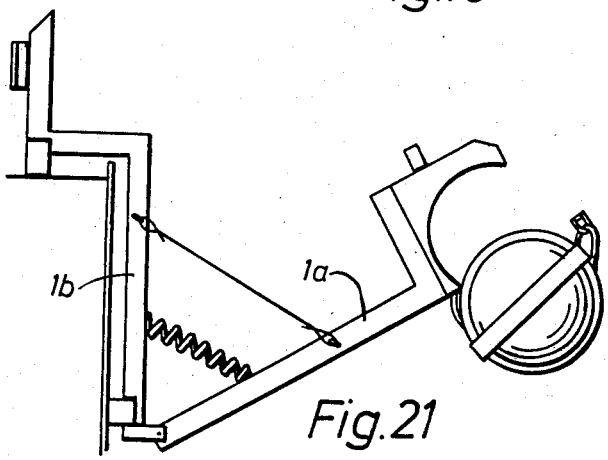
Figure 22:
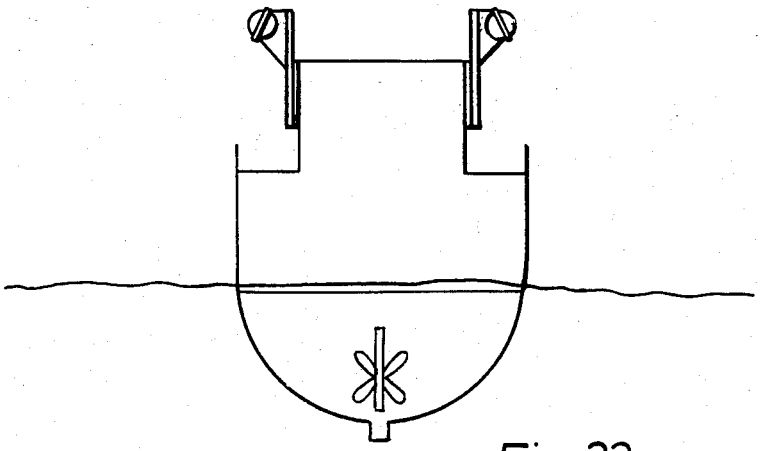
Figure 23:
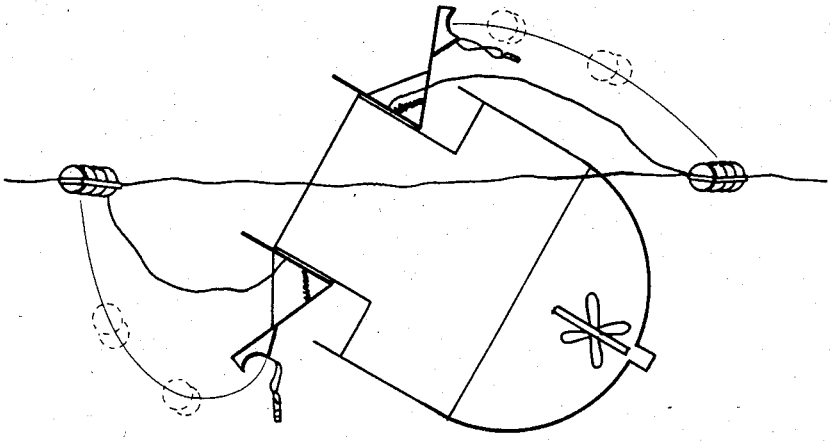
Figure 24:
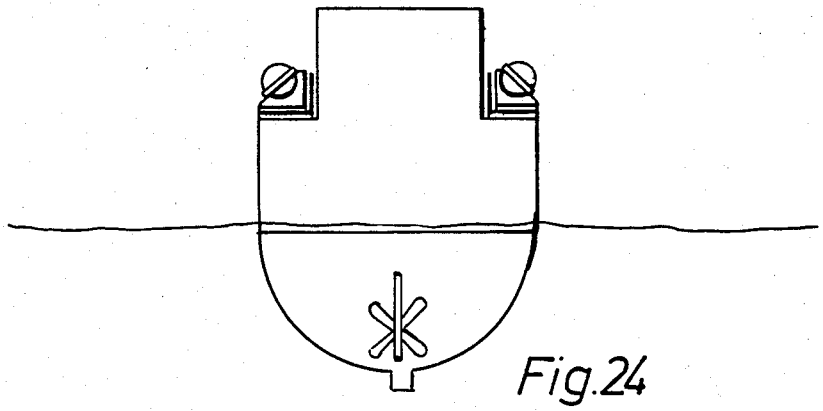
Figure 25:
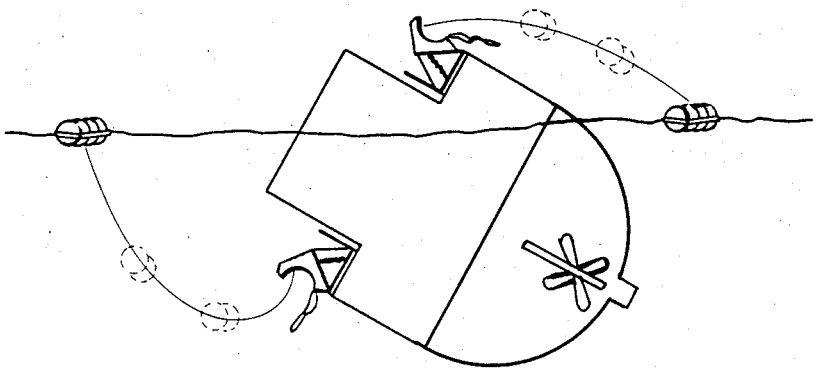
Figure 26:
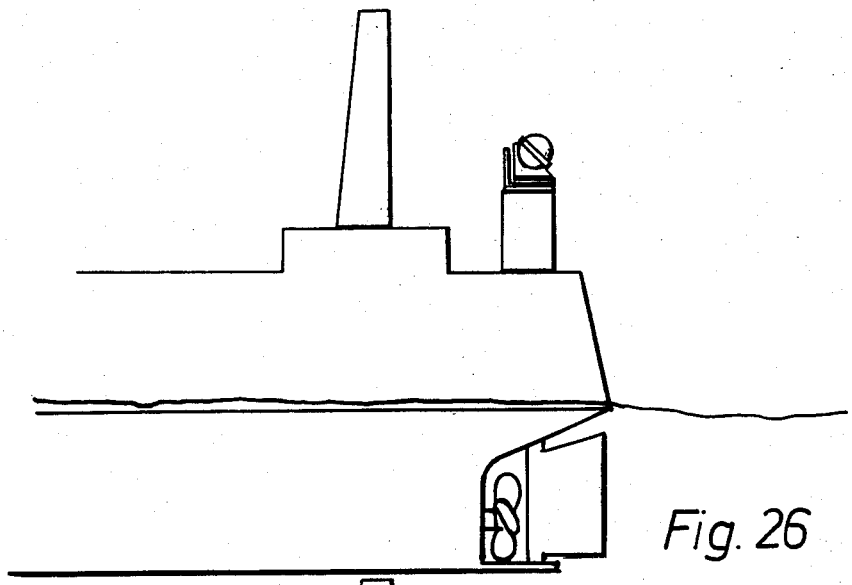
Figure 27:
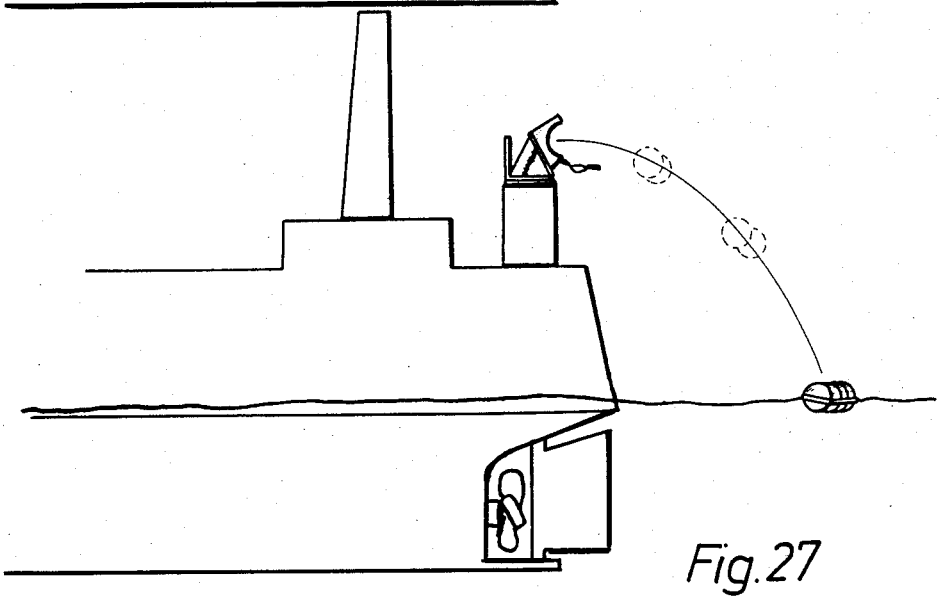
Figure 28:
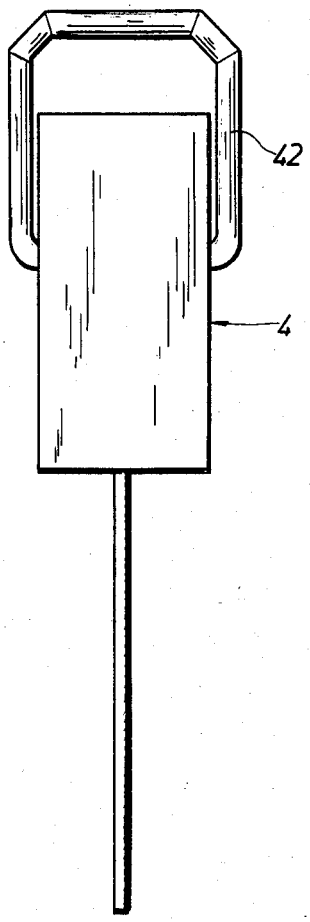
Figure 29:
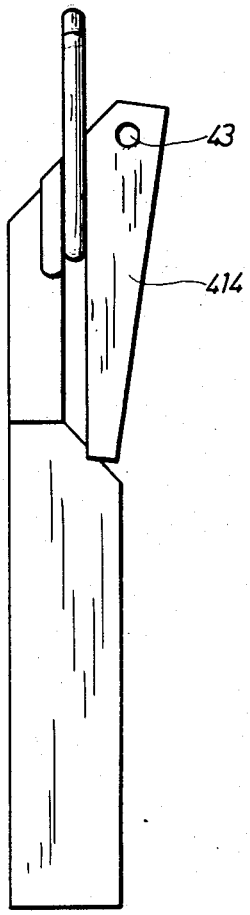
Figure 30:
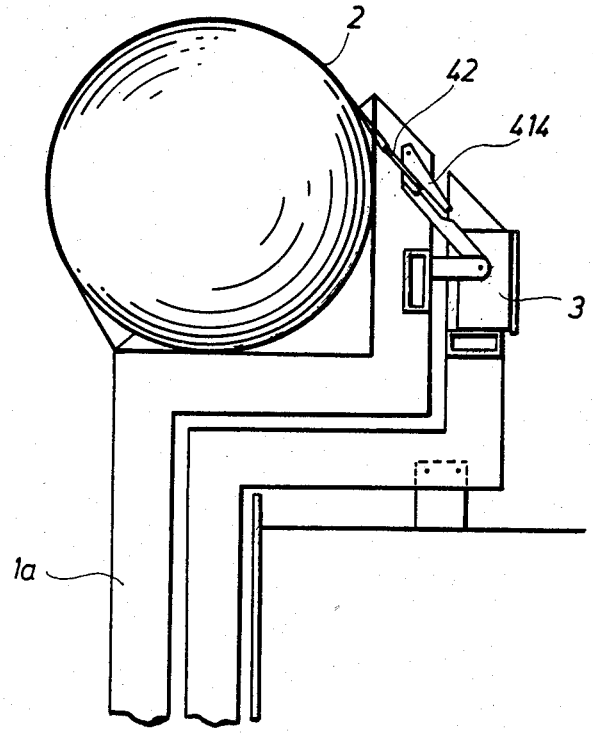
Figure 31:
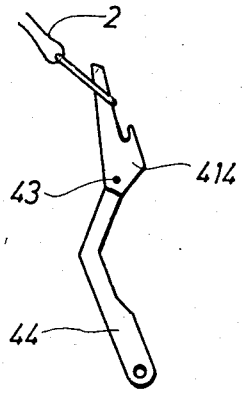
Figure 35:
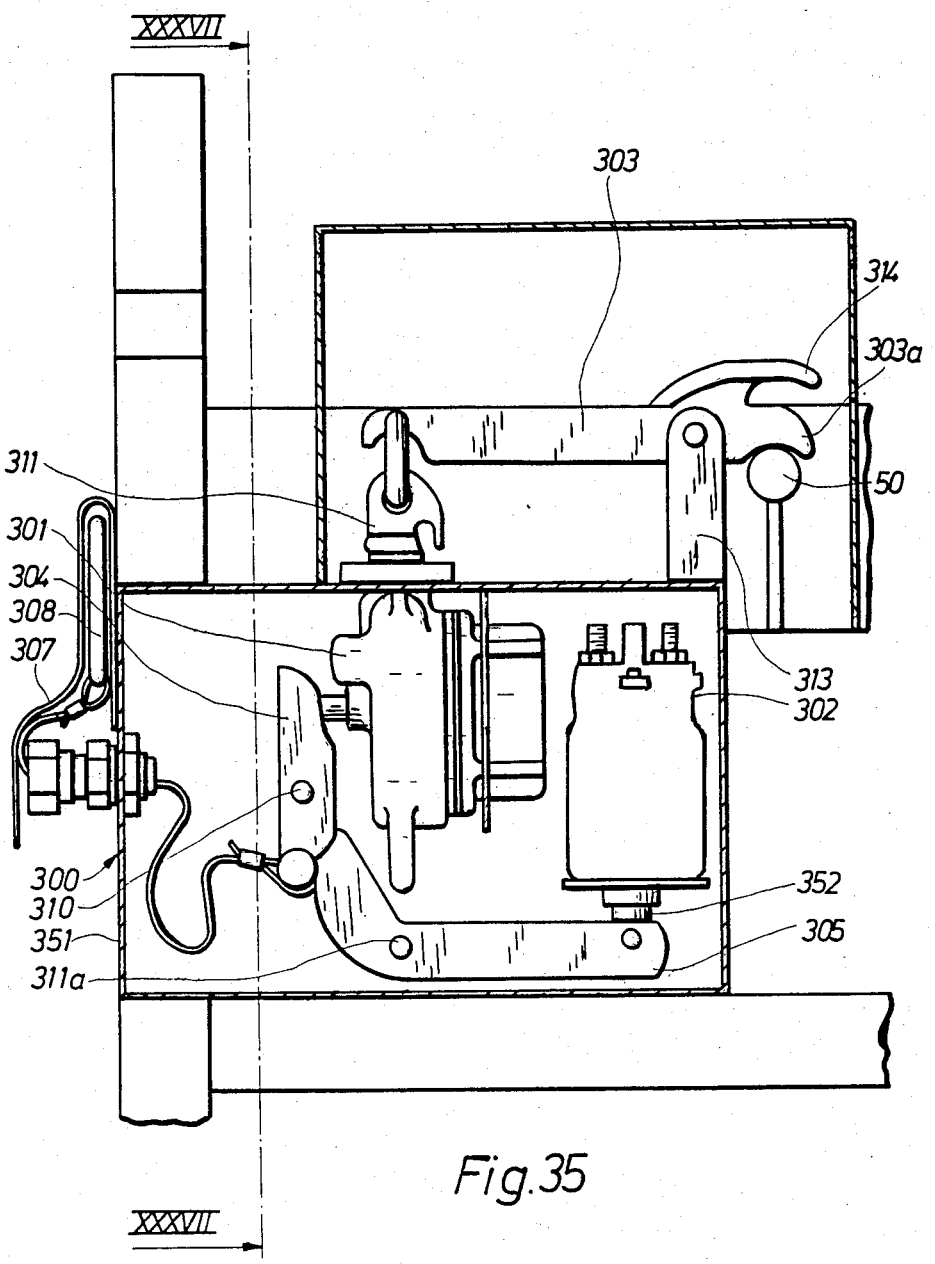
Figure 36:
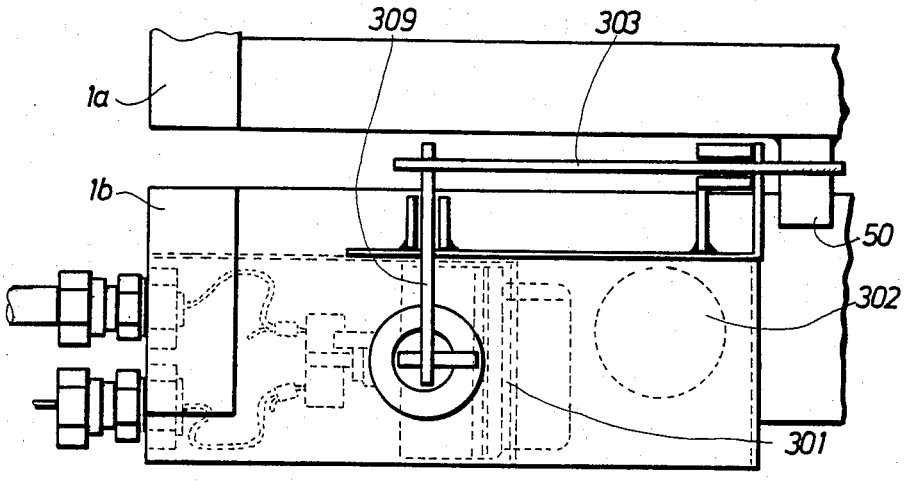
Figure 37:
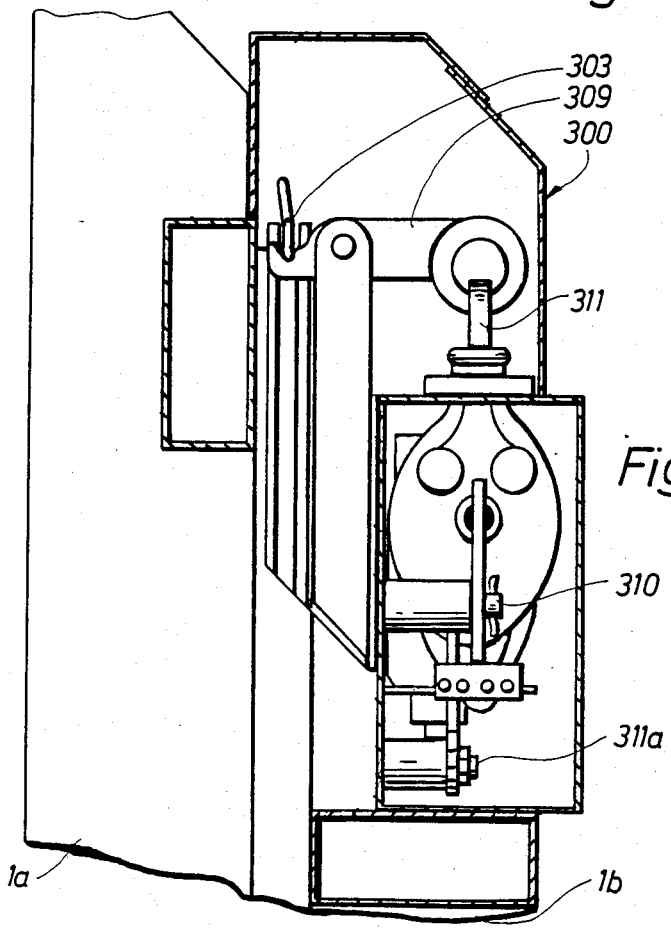

The invention will be described below with reference to the accompanying drawing, in which FIG. 1 is a side view of a first embodiment of the apparatus according to the invention, the second arm means being positioned in the storing position and the float being positioned at the outermost end of said arm means, FIG. 2 corresponds to FIG. 1, but whereby the second arm means is positioned in the ejecting position and the storing means and the ejector have been released, FIG. 3 illustrates a second embodiment of the apparatus according to the invention, whereby the second arm means is positioned as in FIG. 1, but whereby the float is situated slightly aside the end of this arm means, FIG. 4 corresponds to FIG. 3, but whereby the second arm means is positioned in the ejected position, FIG. 5 is a side view of a third embodiment of the apparatus according to the invention, whereby the second arm means is positioned in the storing position and whereby the float is positioned opposite the middle of the second arm means, FIG. 6 corresponds to FIG. 5, but whereby the second arm means is positioned in the ejected position, FIG. 7 is a perspective view of the embodiment of the apparatus of FIG. 1, FIG. 8 is a perspective view on a larger scale of the embodiment of FIG. 7, FIG. 9 is a perspective view of a blocking means, FIG. 10 illustrates an embodiment of the apparatus according to the invention, whereby it is illustrated how a housing including the ejector is formed by three pipe sections, FIG. 11 corresponds to FIG. 10, but whereby the outer pipe section of the housing is pushed into the neighboring pipe section, FIG. 12 is a front view of the embodiment of FIGS. 4 and 11, FIG. 13 illustrates the embodiment of the apparatus of FIGS. 10 and 11, the ejector being released and the parts of the housing being separated, FIG. 14 illustrates a retaining arrangement for the apparatus which serves to release the ejector, i.e. in fact the second arm means, FIG. 15 is a diagrammatic view of part of the retaining arrangement of FIG. 14, the steering arm associated with the retaining arrangement being positioned in its one inclined position, in which the retaining shaft of the retaining arrangement is displaced to the right and has released the blocking means and the second arm means, FIG. 16 corresponds to FIG. 15, but whereby the steering arm is positioned in its second angular position and the retaining shaft is displaced to the left, i.e. to a side in which it locks, i.e. retains, the blocking means and the second arm means, FIG. 17 corresponds to FIG. 16, a top view of the retaining shaft and the steering arm appearing, FIG. 18 illustrates the embodiment of the apparatus of FIG. 1 mounted on two locations on the ship, the floats being positioned in the storing position, FIG. 19 corresponds to FIG. 18, but whereby the ship heels 60° and the ejectors of the two apparatuses have been released in such a manner that the floats are in the water, FIG. 20 illustrates the embodiment of FIG. 1 mounted on a ship, FIG. 21 corresponds to FIG. 20, but whereby the second arm means is turned outwards, FIG. 22 illustrates a ship, on which two specimens of the embodiment of FIG. 2 are mounted, the float being positioned in the storing position, FIG. 23 corresponds to FIG. 22, but whereby the ship heels 60° and the ejector has been released and the floats ejected into the water, FIG. 24 illustrates a ship, on which two specimens of the embodiment of FIG. 3 of the apparatus according to the invention are mounted, the apparatuses being mounted on the side of the ship, FIG. 25 corresponds to FIG. 24, but whereby the ship heels 60° and the ejector of the apparatus has been released and the floats ejected into the water, FIG. 26 illustrates a ship, on which the embodiment of FIG. 3 of the apparatus according to the invention is mounted on the stern of the ship, the float being positioned in the storing position, FIG. 27 corresponds to FIG. 26, but whereby the ejector has been released and the float ejected into the water, FIG. 28 is a top view of the blocking means of FIG. 9 in the closed state, FIG. 29 is a side view of the blocking means of FIG. 28, FIG. 30 is a side view of the blocking means of FIG. 28, the engagement of the blocking means with the holding strap extending across the float appearing, FIG. 31 illustrates the blocking means, whereby its fastening portion has been turned so far that the holding straps of the storing means may slide away from the fastening portion, FIG. 32 illustrates a further embodiment of the blocking means, FIG. 33 illustrates a float mounted in a storing means in the form of a seat member, a holding strap extending across the float and down to a blocking means manually operable by means, of a lever mechanism, FIG. 34 illustrates on a larger scale the blocking means of FIG. 33 with associated lever mechanism, FIG. 35 is a side view of a second embodiment of the retaining arrangement according to the invention mounted on the first arm means secured on the ship, the boxes of the retaining arrangement appearing as if it is transparent, FIG. 36 is a top view of the embodiment of FIG. 35, and FIG. 37 is a sectional view of the embodiment of FIG. 35 taken along the line XXXVII—XXXVVII of FIG. 35.

The embodiment of the apparatus according to the invention illustrated in FIGS. 1 and 2 is of the so-called vertical type. It is intended for mounting on the side of a ship and on the roof of a superstructure thereon, cf. FIGS. 18, 19, 20, and 21. The embodiment shown in FIGS. 3 and 4 of the apparatus according to the invention is intended for mounting on the side of the superstructure of the ship, cf. FIGS. 22 and 23. The embodiment shown in FIGS. 5 and 6 of the apparatus is of the horizontal type and is intended for positioning on the roof of the superstructure, on the deck, on the stem or locations such as for instance the stern as illustrated in FIGS. 26 and 27.

The embodiment shown in FIG. 8 of the apparatus comprises a carrying frame of two mutually movable, preferably turnable arm means 1*a* and 1*b*, whereby the arm means 1*b* is permanently mounted on the ship and the second arm means 1*a* may be turned outwards from the first arm means 1*b* when a float not shown, but positioned under a holding strap 2 shaped as a storing means is released or partly released for ejection and launching thereof. The holding strap 2 is connected with a retaining arrangement 3 through a blocking means 4 also making the holding strap 2 releasable. Under normal conditions, the blocking means 4 retains the holding strap 2 locked. The blocking means is shown in greater details in FIG. 9. This blocking means is manually releasable, and then the holding strap is released from the float. The manual handling of the blocking means 4 is possible without the arrangement 1*a* being swung outwards. The blocking means may, however, also be released by means of a particular retaining arrangement, cf. below.

FIGS. 28, 29, and 30 show how the blocking means may be a substantially V-shaped arm 44, one end of which is provided with a fastening member 414 pivotably mounted. This fastening member 414 may either enter a stopping position, cf. FIGS. 28, 29, and 30, in which the holding strap is retained, or a releasing position, cf FIG. 31, in which the holding strap is being manually released. The blocking means may, as shown, be provided with a hook 42, said fastening member 414, which may shaped as a handle, and a turning pin 43, the fastening member 414 being capable of turning about said pin relative to a V-shaped arm 44 of flat iron. The arm 44 may be connected to a retaining arrangement, which is mentioned below.

An ejector is mounted between the arm means 1*a* and 1*b* and may be shaped as a compression spring 6, cf. FIG. 13 and FIGS. 2, 4, and 6.

When the float is mounted on the arm means 1*a*, it is ejected away from the apparatus and into the sea when the compression spring 6 is released and the arm means 1*a* turned an angle outwards. The compression spring 6 is as shown mounted in a housing of three pipe sections 5. In FIGS. 10, 11, and 12 the spring is compressed and the pipe sections are shown in an inserted position about the compression spring. The compression spring may be turned together by means of some screw bolts 7, cf. FIGS. 10, 11, and 12. In order to restrict the movement of the arm means 1*a*, a move-restricting member in the form of a metal wire 18 is provided. When the metal wire is stretched out, the float is ejected away from the arm means 1*a* and into the sea.

The second arm means 1*a* and consequently the ejector are releasable by means of the retaining arrangement 3 shown in FIG. 14. This arrangement is provided with a displaceable retaining shaft 5 displaceable into the second arm means. FIG. 14 shows the retaining arrangement in the locking state. When a handle 8 is lifted out of a notch 9 in some parts at the bottom of FIG. 14 and is pulled downwards, a metal cable 10 positioned inside a pipe 11 pulls a steering arm 13. The metal cable 10 extends into the box of the retaining arrangement through a friction clutch 12. When the metal cable 10 pulls the steering arm 13, a cam 14 moves the retaining shaft 15 inwards into a releasing position in the retaining arrangement. A compression spring 16 assists in the releasing. Plates 17 are mounted on the retaining shaft 15, and when influenced by the cam 14 these plates move the shaft 15 towards a locking or releasing position. While the retaining shaft 15 was in the locking position, one end thereof projected through the blocking means 4 and a portion of the second arm means 1*a*, cf. FIG. 14. When the retaining shaft 15, however, has reached its releasing position, it clears completely the blocking means 4 and the arm means 1*a*, whereby the latter now under the influence of the ejector is turned by a heavy force away from the first arm means 1*b*.

FIG. 15 illustrates the retaining shaft 15 in the releasing position, whereas FIGS. 16 and 17 illustrate the retaining shaft in the locking position.

It should be noticed that when the embodiments of FIGS. 1 and 3 of the apparatus according to the invention are mounted on a ship, cf. FIGS. 18, 19, 22, and 23, a completely satisfactory launching of the floats is obtained even though the ship in distress heels 60°–70°. Also the apparatus coming below the water level is capable of ejecting its float satisfactorily. A 25 m long lifeline is present between the first arm means of the apparatus and the float.

By pulling the lifeline the float is opened.

FIGS. 32, 33, and 34 illustrate how the blocking means 4 may be used in boats of less than about 50 tons. Floats for boats of this size are usually fastened in storing means in the form of seat portions 21, a holding strap 2 being stretched over the float. When such a float is to be launched, a handle 49 or a handle 414 on the fastening member of the blocking means is subjected to a pull. The holding strap 2 is then released and the float is either rolling away or floating out of its seat and into the sea.

In connection with FIG. 34 it is noted that an opening arm 48 is projecting into the handle 414 of the fastening member. In FIG. 34 this arm is illustrated in its locking position. The opening arm 48 is connected to a handle 49 through a metal cable 412. When the handle 49 is activated the hook 42 of the blocking means 4 slides out of the handle 414 whereby the holding strap 2—on which the hook 42 is positioned—is released.

The retaining arrangement may be shaped in other ways than stated above and may be released, i.e. activated, in other ways than shown. The release may for instance be carried out by means of a hydrostatic sensor means activatable: (1) Manually by means of a release cable and/or (2) electrically by means of a magnetic switch and/or (3) automatically, the hydrostatic sensor means being activatable directly by water or air at a pressure of at least 1.5 m water column, i.e. corresponding to a situation in which the hydrostatic sensor means has reached 1.5 m below the water level during a ship catastrophe.

FIGS. 35, 36, and 37 illustrate how such a retaining arrangement 300 may be shaped. It is mounted on the first fixed arm means 1*b* of the apparatus and it comprises a box 351 including a rod system 311, 309, 303, 303*a*. This rod system is connected at its inner end with a hydrostatic sensor means 301 and at its outer end 3*a* connected in a locking manner with a projecting means 50 projecting from the second arm means, i.e. the turnable arm means 1*a*. When the auxiliary rod 303*a* is in its outermost position in which it presses on the projecting means 50, the second arm means extending towards the first arm means, said rod 303*a* prevents the second arm means from being turned outwards from the first arm means by means of the compression spring 6. Adjacent its outer end the auxiliary rod 303*a* comprises a blocking means in the form of a hook 314 releasing the storing means, preferably the holding straps thereof.

The hydrostatic sensor means 301 is manually releasable in such a manner that the rod system 311, 309, 303, 303*a* is moved into a position in which the auxiliary rod 303*a* is cleared of the projecting means 50 by means of a release lever 304 provided with a release cable 307. When the cable 307 is subjected to a manual pull, the upper end of the release lever 304 is pressed towards the hydrostatic sensor means 301, whereby said sensor means is released in such a manner that the rod system 311, 309, 303, 303*a* is moving. At one end the cable comprises a handle 308 which can be suitably positioned in the ship. Usually the cable is made of stainless steel and completely or partially coated with nylon. The cable extends into a box 351 through a nipple 306 lined with nylon too in order to take care of the cable.

A turnable auxiliary release lever 305 may as shown be coupled to the release lever 304, said auxiliary release lever being turnable by means of a stick 352 displaceably situated in an electric coil 302. When current is fed to the coil, the stick 352 is displaced whereby the levers 305 and 304 are moved in such a manner that the hydrostatic sensor means 301 is activated and the above levers 311, 309, 303, 303*a* are moved.

Finally the hydrostatic sensor means 301 may also be automatically releasable by means of water or air penetrating therein. The hydrostatic sensor means comprises a release plate sensitive to hydrostatic pressures. When subjected to a liquid or air pressure of 1.5 m water column or more this release plate releases the rod system 311, 309, 303, 303*a*. The box 351 is preferably provided with openings not shown ensuring that water may flow therein in case the ship sinks as a consequence of a catastrophe. The box 351 may also be provided with an air tube not shown for the supply of air to the interior of the box from large rooms in the ship in such a manner that it is ensured that the hydrostatic sensor means 301 is released even though said openings in the box should be closed because of ice. The decisive factor is that the release plate of the hydrostatic sensor means 301 is subjected to a pressure of at least 1.5 m water column from a continuous medium such as water or air.

In connection with the release lever 304 it is noted that it is pivotably situated on a shaft 310, cf. FIG. 37. The auxiliary release lever 305 is pivotably mounted on a shaft 311, cf. FIG. 37 too.

The invention may be varied in many ways without thereby deviating from the scope of the invention.

I claim:

1. Apparatus for storing and launching a float or the like from a ship comprising: first and second arm means; means pivoting said first arm means for swinging movement relative to said second arm means, said second arm means being adapted to be fixed to a ship; bias means connected between said first and second arm means for biasing said first arm means in a direction away from said second arm means; storing means for releasably holding a float to said second arm means; a retaining shaft axially movable between a retaining position and a releasing position; a blocking assembly connected to said storing means and connected to said retaining shaft in such a manner that in the retaining position of said retaining shaft said storing means holds the float to said second arm means and such that movement of said retaining shaft to its releasing position releases said blocking assembly so that said holding means releases the float from said first arm means, said blocking assembly including a manually releasable part which upon manual release permits said storing means to release the float from said second arm means, said retaining shaft in its retaining position also cooperating with said second arm means in a manner to restrain swinging of said second arm means by said bias means and in a manner to release said second arm means when said retaining shaft moves to its releasing position; and means for moving said retaining shaft from its retaining position to its releasing position.

2. Apparatus as in claim 1 wherein said bias means includes a compression spring.

3. Apparatus as in claim 2 wherein said spring is mounted inside a housing of three pipe sections arranged inside one another.

4. Apparatus as in claim 1 wherein said means for moving said retaining shaft includes a steering shaft cooperating with said retaining shaft and a lever-type handle for moving said steering shaft.

5. Apparatus as in claim 4 including a cable located between said handle and said steering shaft.

6. Apparatus as in claim 1 wherein said means for moving said retaining shaft is a remote control means.

* * * * *

UNITED STATES PATENT AND TRADEMARK OFFICE

CERTIFICATE OF CORRECTION

PATENT NO. : 4,633,802

DATED : January 6, 1987

INVENTOR(S) : Karl Hinrik Karlsson Olsen

It is certified that error appears in the above-identified patent and that said Letters Patent is hereby corrected as shown below:

Claim 1, line 9, "second" should read --first--;
line 14, after "float" the words --on said first arm means close-- should be inserted;
line 17, "holding" should read --storing--;
line 21, "second" should read --first--;
line 24, "second" should read --first--;
Line 25, "second" should read --first--.

Signed and Sealed this

Twenty-third Day of February, 1988

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,633,802

DATED : January 6, 1987

INVENTOR(S) : Karl Hinrik Karlsson Olsen

It is certified that error appears in the above-identified patent and that said Letters Patent is hereby corrected as shown below: On the title page insert -- Foreign Application Priority Data

| | | |
|---|---|---|
| September 12, 1983 | Iceland | 2852 |
| September 12, 1983 | Iceland | 2853 |
| September 6, 1984 | Iceland | 2942 -- |

Signed and Sealed this

Twelfth Day of April, 1988

*Attest:*

DONALD J. QUIGG

*Attesting Officer*

*Commissioner of Patents and Trademarks*